US006588385B2

(12) United States Patent
Fuwa

(10) Patent No.: US 6,588,385 B2
(45) Date of Patent: Jul. 8, 2003

(54) ENGINE VALVE DRIVE CONTROL APPARATUS AND METHOD

(75) Inventor: Toshio Fuwa, Nagoya (JP)

(73) Assignee: Toyota Jidosha Kabushiki Kaisha, Toyota (JP)

( * ) Notice: Subject to any disclaimer, the term of this patent is extended or adjusted under 35 U.S.C. 154(b) by 0 days.

(21) Appl. No.: 10/020,912

(22) Filed: Dec. 19, 2001

(65) Prior Publication Data

US 2002/0078910 A1 Jun. 27, 2002

(30) Foreign Application Priority Data

Dec. 21, 2000 (JP) ..... 2000-388740

(51) Int. Cl.[7] ..... F01L 9/04

(52) U.S. Cl. ..... 123/90.11; 251/129.01; 251/129.15; 251/129.16

(58) Field of Search ..... 123/90.11; 251/129.01, 251/129.02, 129.15, 129.16

(56) References Cited

U.S. PATENT DOCUMENTS 5,636,601 A * 6/1997 Moriya et al. ..... 123/90.11
5,647,311 A * 7/1997 Liang et al. ..... 123/90.11
5,868,108 A * 2/1999 Schmitz et al. ..... 123/90.11
5,996,539 A * 12/1999 Gobel et al. ..... 123/90.11
6,044,814 A * 4/2000 Fuwa ..... 123/90.11
6,285,151 B1 * 9/2001 Wright et al. ..... 318/560
6,390,039 B2 * 5/2002 Fuwa ..... 123/90.11
6,477,993 B1 * 11/2002 Katsumata et al. ..... 123/90.11

FOREIGN PATENT DOCUMENTS

JP A-9-217859 8/1997
JP 11132017 A * 5/1999 ..... F01L/9/04
JP A-11-257036 9/1999

* cited by examiner

*Primary Examiner*—Thomas Denion
*Assistant Examiner*—Ching Chang
(74) *Attorney, Agent, or Firm*—Kenyon & Kenyon

(57) ABSTRACT

A drive control apparatus and a control method are provided for controlling driving of an engine valve of an internal combustion engine, utilizing an electromagnetic force generated by an electromagnet or electromagnets. A magnitude of an external force applied to the engine valve is estimated, and a target operating state of the engine valve is set in view of the estimated magnitude of the external force. Then, a current applied to the electromagnet(s) is controlled in accordance with an actual operating state and the target operating state of the engine valve, so that the actual operating state substantially coincides with the target operating state.

30 Claims, 8 Drawing Sheets

ENGINE VALVE DRIVE CONTROL APPARATUS AND METHOD

INCORPORATION BY REFERENCE

The disclosure of Japanese Patent Application No. 2000-388740 filed on Dec. 21, 2000, including the specification, drawings and abstract, are incorporated herein by reference in its entirety.

BACKGROUND OF THE INVENTION

1. Field of the Invention

The invention relates to engine valve drive control apparatus and method for controlling driving of engine valves of an internal combustion engine based on electromagnetic force generated by electromagnets.

2. Description of Related Art

Valve drive apparatuses for driving engine valves, such as intake valves and exhaust valves, of internal combustion engines by use of electromagnetic force of electromagnets, have been known. The valve drive apparatus of this type is desired to ensure a high operating stability when driving the engine valves. Furthermore, it is desirable to minimize the amount of electric power that is consumed for driving the engine valves, and to suppress occurrence of noises when the engine valve reaches either one of the opposite ends of its stroke (or a range of its displacement), namely, the fully closed position or the fully open position.

In a known apparatus as disclosed in Japanese Patent Laid-open Publication No. 9-217859, the actual operating state of the engine valve is detected, and the electromagnetic force generated by a selected one of the electromagnets is controlled so that the actual operating state coincides with a target operating state of the valve. In this manner, the electromagnetic force of the electromagnet is controlled to a magnitude that meets various requirements as mentioned above.

When controlling the electromagnetic force generated by the electromagnet, the apparatus as disclosed in the above-identified publication operates to determine, for example, a displacement deviation between an actual displacement of the engine valve and a target displacement thereof, and apply a controlled current to the selected electromagnet so that the resulting electromagnetic force has a magnitude suitable for making the actual displacement of the engine valve equal to the target displacement thereof. If the displacement deviation is large, for example, the exciting current applied to the electromagnet is increased so that the engine valve is opened or closed with accordingly increased electromagnetic force.

It is, however, advisable to note that the engine valves are subjected to external forces generated in accordance with the internal pressure within a corresponding combustion chamber of the engine, the intake pressure or the exhaust pressure, and the like. If the relationship between the external forces and the target operating state, such as a target displacement, is not appropriate, namely, if the target displacement is determined without taking account of the current magnitude of the external force, the exciting current applied to the electromagnet may be excessively increased, resulting in an increase in the power consumption or occurrence of noises upon opening or closing of the engine valve. In other cases, the electromagnetic force for driving the engine valve may be short of the required force for driving the engine valve, resulting in a reduction in the operating stability of the engine valve.

If a pattern of the target displacement with respect to time is set so as to meet the above-described various requirements under a condition that the external force applied to the engine valve is relatively small, the actual displacement does not follow the pattern of the target displacement when the external force applied to the engine valve is relatively large since the displacement velocity (driving velocity) of the engine valve is reduced with an increase in the external force. In this case, an excessively large current may be applied to the selected electromagnet, resulting in an increased amount of power consumption and noises occurring upon opening and closing of the valve. If a pattern of the target displacement with time is set so as to meet the above-described various requirements under a condition that the external force applied to the engine valve is relatively large, on the other hand, the displacement velocity of the engine valve is increased when the external force applied to the engine valve is relatively small, and therefore the exciting current applied to the electromagnet is reduced so as to reduce or restrict the displacement of the engine valve. As a result, the electromagnetic force generated by the electromagnet may fall short of the required force for driving the engine valve, resulting in a deteriorated operating stability of the engine valve.

SUMMARY OF THE INVENTION

It is therefore a first object of the invention to provide a control apparatus for controlling driving of an engine valve, which apparatus permits the engine valve to operate with a sufficiently high operating stability irrespective of the external force applied to the engine valve, while at the same time avoiding an increase in the electric power consumed for driving the valve and/or occurrence of noise upon opening and closing of the valve.

To accomplish the above and/or other object(s), there is provided according to one aspect of the invention a drive control apparatus for controlling driving of an engine valve of an internal combustion engine, utilizing an electromagnetic force generated by at least one electromagnet. A controller of the apparatus estimates a magnitude of an external force applied to the engine valve, and sets a target operating state of the engine valve in view of the estimated magnitude of the external force. Then, current applied to the electromagnet(s) is controlled in accordance with an actual operating state and the target operating state of the engine valve, so that the actual operating state substantially coincides with the target operating state.

The drive control apparatus constructed as described above is able to appropriately set the target operating state of the engine valve in accordance with the external force applied to the valve, so as to achieve a desirable opening or closing action of the engine valve. By controlling current applied to a selected electromagnet so that the actual operating state of the engine valve coincides with the target operating state, therefore, the control apparatus permits the engine valve to be driven with an appropriate electromagnetic force that varies depending upon the external force. Accordingly, the engine valve is operated with a sufficiently high operating stability without suffering from a lack or shortage of electromagnetic force required for driving the engine valve. Furthermore, the engine valve is prevented from being driven with excessively large electromagnetic force, which would result in an increase in the amount of power consumption and/or occurrence of noise and vibrations upon opening and closing of the valve.

Here, the operating state of the engine valve may be represented by a driving velocity or a displacement of the engine valve.

In one preferred embodiment of the invention, the control units calculates a feedback current having a current value that varies with a deviation of the actual operating state from the target operating state, and controls the current applied to the electromagnet(s), based on the calculated feedback current.

With the above-described arrangement, the feedback current used for energization control of the selected electromagnet for driving the engine valve is calculated so that the actual operating state of the engine valve substantially coincides with the target operating state that is set in view of the external force applied to the engine valve. By controlling current applied to the selected electromagnet based on the thus calculated feedback current, the drive control apparatus is able to drive the engine valve with a suitably controlled electromagnetic force corresponding to the external force, thereby suppressing or avoiding various problems that would otherwise be caused by excessively small or large electromagnetic force.

In the above-indicated preferred embodiment of the invention, the control unit may set a feedback gain used when calculating the feedback current, such that the feedback gain increases as an air gap between the engine valve and a selected one of the electromagnets increases.

The electromagnetic force applied to the engine valve varies depending upon the size of the air gap between the engine valve and the selected one of the electromagnets. Namely, assuming that the same exciting current is applied to the electromagnet, the electromagnetic force acting on the engine valve decreases with an increase in the air gap. In the above arrangement in which the feedback gain is set to a greater value as the air gap increases, the electromagnet is able to generate electromagnetic force of a magnitude that is suitable or appropriate for the size of the air gap, so that the actual operating state of the engine valve can be controlled with high reliability to the target operating state within a sufficiently short time.

In another preferred embodiment of the invention, the control unit sets a feed-forward current having a current value that is added to the feedback current so as to make the actual operating state substantially equal to the target operating state, and controls the current applied to the at least one electromagnet, based on the feed-forward current and the feedback current.

In the above embodiment, feed-forward control based on feed-forward current, as well as the above-indicated feedback control, is performed during control of current applied to the selected electromagnet, so that the actual operating state of the engine valve coincides with the target operating state thereof. Accordingly, the control of the current applied to the electromagnet can be accomplished without a time delay.

In a further preferred embodiment of the invention, the estimating unit estimates the magnitude of the external force based on the actual operating state of the engine valve that is detected while the at least one electromagnet is held in a non-energized state in which no current is applied to the engine valve.

With the above arrangement, there is no need to provide a new sensor for estimating the external force acting on the engine valve.

BRIEF DESCRIPTION OF THE DRAWINGS

The foregoing and/or further objects, features and advantages of the invention will become more apparent from the following description of preferred embodiments with reference to the accompanying drawings, in which like numerals are used to represent like elements and wherein.

DETAILED DESCRIPTION OF PREFERRED EMBODIMENTS

A preferred embodiment in which the invention is applied to a drive control apparatus for controlling driving of intake valves and exhaust valves of an internal combustion engine will be described in detail.

In this embodiment, all of the intake valves and the exhaust valves are constructed as electromagnetically driven valves that are opened and closed with electromagnetic force of electromagnets applied thereto. The intake valves and the exhaust valves are substantially identical in construction and are controlled in substantially the same manner when they are driven. In the following, therefore, the construction and operation of, for example, an exhaust valve will be described in detail.

Figure 1:
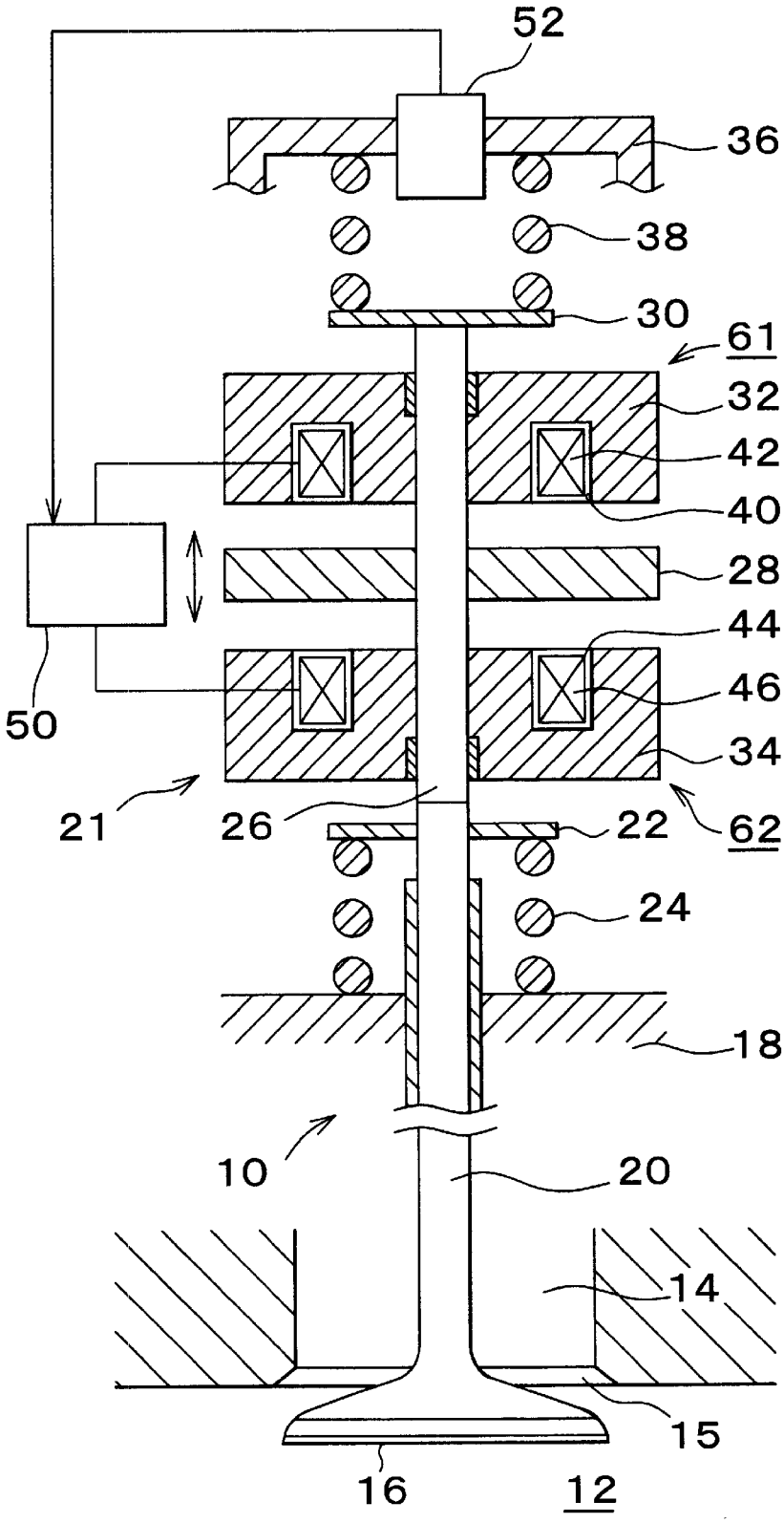
FIG. 1 is a view schematically showing the construction of an exhaust valve and a control apparatus thereof.

Referring to FIG. 1, an exhaust valve 10 includes a valve shaft 20, a valve body 16 provided at one of axially opposite ends of the valve shaft 20, and an electromagnetic drive portion 21 for driving the valve shaft 20 in axially opposite directions. The valve shaft 20 is supported by the cylinder head 18 such that the shaft 20 can reciprocate by means of the electromagnetic drive portion 21. The cylinder head 18 has an exhaust port 14 that communicates with a combustion chamber 12 of the engine. A valve seat 15 is formed near an opening of the exhaust port 14. As the valve shaft 20 is reciprocated, the valve body 16 rests or abuts upon the valve seat 15 to close the exhaust port 14, and is moved away from the valve seat 15 to open the exhaust port 14.

A lower retainer 22 is provided on an end portion of the valve shaft 20 remote from the valve body 16. A lower spring 24 is disposed in a compressed state between the lower retainer 22 and the cylinder head 18. The valve body 16 and the valve shaft 20 are urged in a valve closing direction (i.e., upward in FIG. 1) under elastic force of the lower spring 24.

The electromagnetic drive portion 21 has an armature shaft 26 that is disposed coaxially with the valve shaft 20. A disc-like armature 28 made of a high-magnetic-permeability material is fixed to a substantially middle portion of the armature shaft 26, and an upper retainer 30 is fixed to one end of the armature shaft 26. The other end of the armature shaft 26 remote from the upper retainer 30 abuts on the end portion of the valve shaft 20 provided with the lower retainer 22.

In a casing (not shown) of the electromagnetic drive portion 21, an upper core 32 is fixedly positioned between the upper retainer 30 and the armature 28, and a lower core 34 is fixedly positioned between the armature 28 and the lower retainer 22. Each of the upper core 32 and the lower core 34 is made of a high-magnetic-permeability material, and assumes an annular shape. The armature shaft 26 extends through a central portion of each annular core 32, 34 such that the shaft 26 can reciprocate relative to the cores 32, 34.

An upper spring 38 is disposed in a compressed state between the upper retainer 30 and an upper cap 36 that is provided in the casing. The elastic force of the upper spring 38 urges the armature shaft 26 toward the valve shaft 20. In turn, the armature shaft 26 urges the valve shaft 20 and the valve body 16 in a valve opening direction (i.e., downward in FIG. 1).

A displacement sensor 52 is attached to the upper cap 36. The displacement sensor 52 outputs a voltage signal that varies in accordance with the distance between the displacement sensor 52 and the upper retainer 30. It is thus possible to detect a displacement of the armature shaft 26 or the valve shaft 20, that is, a displacement of the exhaust valve 10, based on the voltage signal of the displacement sensor 52.

An annular groove 40 having a center located on the axis of the armature shaft 26 is formed in a lower surface of the upper core 32 that faces the armature 28. An upper coil 42 is received in the annular groove 40. The upper coil 42 and the upper core 32 form an electromagnet 61 for driving the exhaust valve 10 in the valve closing direction.

An annular groove 44 having a center located on the axis of the armature shaft 26 is formed in an upper surface of the lower core 34 that faces the armature 28. A lower coil 46 is received in the annular groove 44. The lower coil 46 and the lower core 34 form an electromagnet 62 for driving the exhaust valve 10 in the valve opening direction.

In operation, electric current is applied to the coils 42, 46 of the electromagnets 61, 62 under control of an electronic control unit 50 that governs various controls of the internal combustion engine. The electronic control unit 50 includes a CPU, a memory, and a drive circuit for supplying exciting current to the coils 42, 46 of the electromagnets 61, 62. The electronic control unit 50 further includes an input circuit (not shown) for receiving a detection signal from the displacement sensor 52 and other signals, an A/D converter (not shown) that converts the detection signals as analog signals into corresponding digital signals, and so on.

FIG. 1 shows a state of the exhaust valve 10 in which neither the upper coil 42 nor the lower coil 46 is supplied with exciting current, and therefore no electromagnetic force is generated by the electromagnets 61, 62. In this state, the armature 28 is not attracted by electromagnetic force of either of the electromagnets 61, 62, but rests at an intermediate position between the cores 32, 34 at which the elastic forces of the springs 24, 38 are balanced with each other. With the exhaust valve 10 held in the state of FIG. 1, the valve body 16 is spaced apart from the valve seat 15 such that the exhaust port 14 is in a half-open state. Hereinafter, the position of the exhaust valve 10 in the state of FIG. 1 will be referred to as "neutral position".

Next, the operation of the exhaust valve 10 that is driven through control of current applied to the coils 42, 46 will be described.

Before driving of the exhaust valve 10 in the opening and closing directions is started, a process (which will be called "initial driving process") is implemented to displace or move the exhaust valve 10 from the neutral position to a fully closed position corresponding to one end of the stroke of the valve shaft 20, and hold the exhaust valve 10 still or stationary in this position. In the initial driving process, exciting current is applied from the drive circuit of the electronic control unit 50 alternately to the coils 42, 46 at predetermined time intervals. With the current applied to the coils 42, 46 thus controlled, the armature 28, the armature shaft 26, the valve shaft 20, etc. are forcibly oscillated under the influences of the elastic forces of the springs 24, 38 and the electromagnetic forces generated alternately by the electromagnets 61, 62. Thus, the amplitude of the oscillation of the armature 28 gradually increases until the armature 28 is brought into abutment with the upper core 32. At the moment when the armature 28 abuts on the upper core 32, the current stops being applied to the lower coil 46, and the upper coil 42 is continuously supplied with a constant exciting current. As a result, the armature 28 is attracted to the upper core 32 by the electromagnetic force generated by the electromagnet 61, and is maintained in this state in which the armature 28 rests upon the upper core 32. Thus, the exhaust valve 10 is held in the fully closed position, which is the initial operating state that permits subsequent opening and closing actions of the valve 10.

In order to open and close the exhaust valve 10 initially placed in the fully closed position, in synchronism with the operation of the internal combustion engine, an exciting current (hereinafter referred to as "command current I"), which is a sum of a feed-forward current component (hereinafter referred to as "FF current If") and a feedback current component (hereinafter referred to as "FB current Ib"), is supplied from the drive circuit of the electronic control unit 50 selectively to the coils 42, 46 of the electromagnets 61, 62.

The driving force for opening and closing the exhaust valve 10 is basically determined by the elastic forces of the springs 24, 38, the masses of the valve body 16, the valve shaft 20, the armature 28, the armature shaft 26, and so on. The driving force also varies depending upon the magnitudes of frictional resistance at various sliding portions including, for example, interfaces between the armature shaft 26 and the cores 32, 34, and an interface between the valve shaft 20 and the cylinder head 18. Furthermore, since the valve body 16 receives external force based on pressures within the combustion chamber 12 and the exhaust port 14, the driving force acting on the exhaust valve 10 changes under the influence of the external force.

In order to ensure a sufficiently high operating stability of the exhaust valve 10, it is necessary to set the magnitudes of the electromagnetic force generated by the electromagnets 61, 62, in other words, the amounts of exciting current supplied to the coils 42, 46, to appropriate values so that the resulting driving force reflects the frictional resistance at various sliding portions, and the external force due to the pressures within the combustion chamber 12 and the like.

While the magnitude of frictional resistance at each sliding portion is regarded as being substantially constant regardless of the engine load, the magnitude of external force due to the pressures in the combustion chamber 12 and the like is likely to change greatly in accordance with the engine load. For example, since the combustion pressure increases with an increase in the engine load, the pressure within the combustion chamber 12 at the time of opening of the exhaust valve 10 and the exhaust pressure in the exhaust port 14 are accordingly increased, resulting in increases in the external force due to the above-indicated pressures. Therefore, if the exciting current applied to the coils 42, 46 is determined without taking the external force into consideration, the electromagnetic force for driving the exhaust valve 10 may become insufficient, resulting in a reduction in the operating stability of the exhaust valve 10. In other cases, the exhaust valve 10 may be driven by excessively large electromagnetic force, resulting in an increase in the power consumption, and/or vibrations and noises (including sounds generated by contacts between the armature 28 and the cores 32, 34, and collision between the valve seat 15 and the valve body 16, for example) upon opening and closing of the exhaust valve 10.

According to the embodiment of the invention, therefore, the FF current If and the FB current Ib are appropriately set so as to reflect the frictional resistance and the external force due to the pressure in the combustion chamber 12 and the like, so that the exhaust valve 10 operates with a sufficiently high stability, and does not suffer from the above-described problems, such as increased power consumption and the noises and vibrations occurring upon opening and closing thereof.

Next, an operation to control driving of the exhaust valve 10 when it is opened will be described with reference to the time chart of FIG. 2, and an operation to control driving of the exhaust valve 10 when it is closed will be described with reference to the time chart of FIG. 5.

Figure 2:
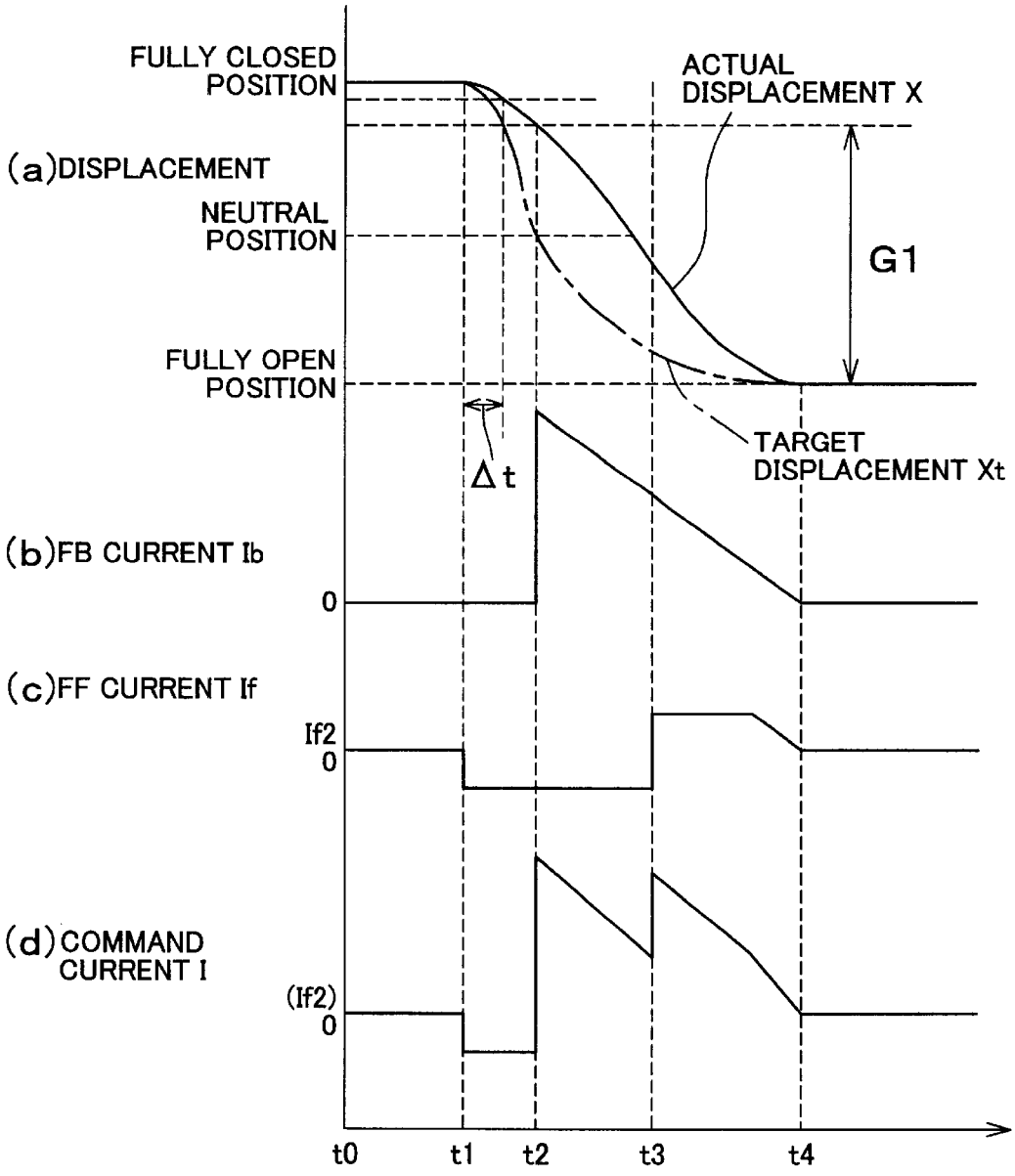
FIG. 2 is a time chart illustrating changes, with time, of target displacement and actual displacement of the exhaust valve of FIG. 1, feedback current, feed-forward current, and command current, when the exhaust valve is opened.

In FIG. 2, (a) indicates changes in the target displacement Xt and the actual displacement X of the exhaust valve 10 with time when it is opened, and (b), (c) and (d) indicate changes in the FB current Ib, FF current If and the command current I with time.

In a period between time t0 and time t1 as shown in FIG. 2, the magnitude of the FF current If is set to If2 (hold current) so that the armature 29 is kept attracted to the upper core 32 and held in this initial position. In this period, the FB current Ib is set to zero. Thus, the command current I supplied to the upper coil 42 is made equal to the holding current If2, and the exhaust valve 10 is held in the fully closed position.

In order to open the exhaust valve 10 from this initial position, the FF current If is initially set to zero at time t1, so that the supply of the command current I to the upper coil 42 is stopped, and the exhaust valve 10 is released from the fully closed position. Since the command current I immediately after releasing of the exhaust valve 10 from the fully closed position is equal to zero, a movable portion of the exhaust valve 10 displaces or moves toward the fully open position under the biasing force of the upper spring 38. Between time t1 and time t2 at which an air gap G between the armature 28 and the lower core 34 reaches a predetermined value G1, both the FF current If and the FB current Ib are kept equal to zero.

The electronic control unit 50 estimates the magnitude of the external force that acts on the exhaust valve 10, based on the actual displacement X (indicated by a solid line at (a) in FIG. 2) measured at a point of time when a time period Δt has elapsed from the above-indicated point of time t1 at which the exhaust valve 10 is released from the fully closed position. The above time period Δt is set to a value that allows estimation of the external force based on the actual displacement X to be completed within the period between time t1 and time t2. The smaller the actual displacement X from the fully closed position is at the point of time when the time Δt has elapsed, the larger the estimated external force that acts against the opening action of the exhaust valve 10.

Figure 3:
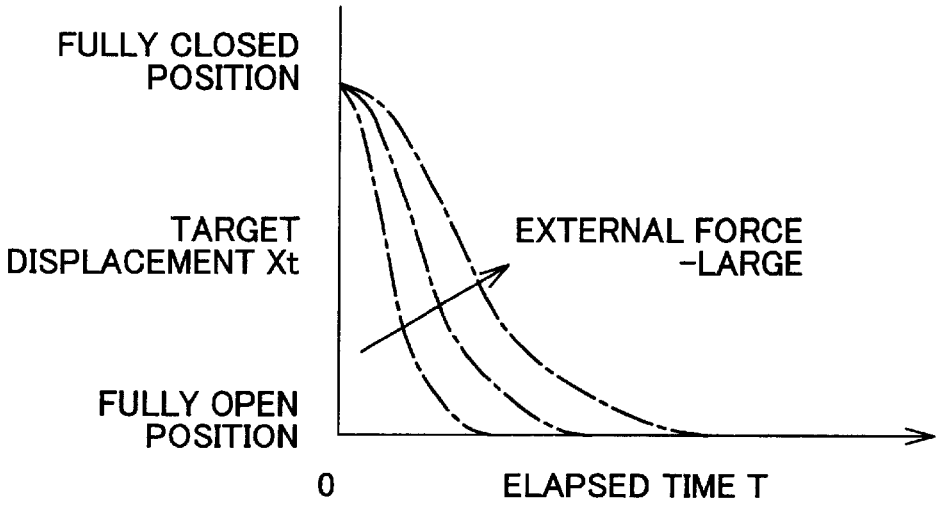
FIG. 3 is a graph showing a plurality of patterns of changes in the target displacement of the exhaust valve upon opening thereof, with respect to elapsed time, wherein each pattern corresponds to each of different magnitudes of external force.

The electronic control unit 50 calculates the FF current If and the target displacement Xt of the exhaust valve 10 (as indicated by a one-dot chain line at (a) in FIG. 2), based on the estimated external force and the elapsed time T as measured from t1 at which the exhaust valve 10 is released from the fully closed position. FIG. 3 shows a plurality of patterns of changes in the thus calculated target displacement Xt with time (elapsed time T), each of the patterns corresponding to each of different magnitudes of the estimated external force. As is apparent from FIG. 3, the patterns of the target displacement Xt show a tendency that time required for the exhaust valve 10 to move from the fully closed position to the fully open position increases with an increase in the external force.

The FB current Ib is calculated so that the actual displacement X of the exhaust valve 10 (as indicated by the solid line) at each point of time becomes equal to the target displacement Xt at the corresponding point of time. Thus, the FB current Ib and the FF current If are set in view of the external force.

Figure 4:
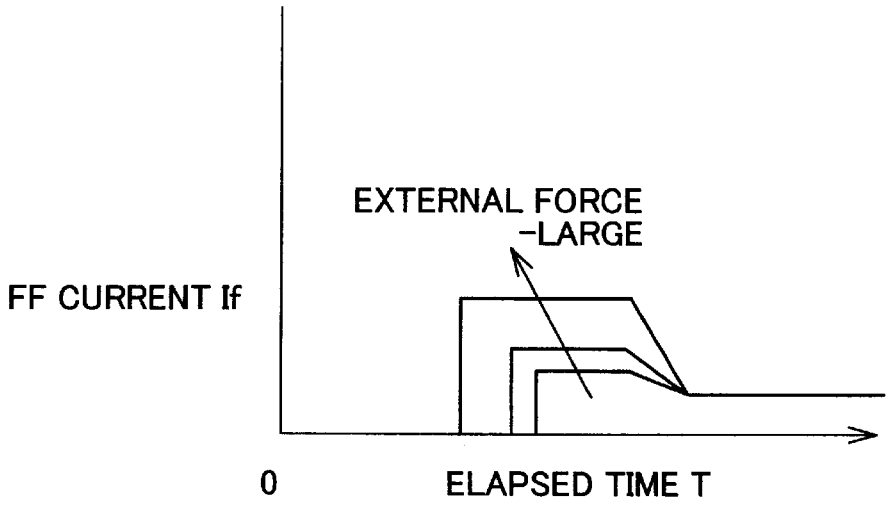
FIG. 4 is a graph showing a plurality of patterns of changes in the feed-forward current with respect to elapsed time, wherein each pattern corresponds to each of different magnitudes of the external force.

More specifically, the FF current If is calculated based on the estimated external force and the elapsed time T, to be thereby set to a current value that causes the actual displacement X to follow the pattern of the target displacement Xt that is selected depending upon the external force. FIG. 4 shows a plurality of patterns of changes in the thus calculated FF current If with time (elapsed time T), each of the patterns corresponding to each of different magnitudes of the external force. As is apparent from FIG. 4, the timing in which the FF current becomes larger than zero is advanced as the external force increases, and the magnitude of the FF current increases with an increase in the external force.

Upon and after time t2 (in FIG. 2) at which the air gap G becomes equal to the predetermined value G1, the FB current Ib is calculated based on a deviation ΔX of the actual displacement X from the target displacement Xt that varies depending upon the external force. Namely, the FB current Ib is determined so that the displacement deviation ΔX is reduced or eliminated. During a period between time t2 and time t3 at which the FF current If becomes larger than zero, the command value I is set equal to the FB current Ib, and only feedback control based on the FB current Ib is performed so as to control current applied to the lower coil 46.

Once the elapsed time T reaches time t3 at which the FF current If becomes larger than zero, the FF current If is set to a value (larger than zero) that varies with the elapsed time T and the estimated external force. Thus, the command value I is calculated as a sum of the FF current If and the FB current Ib, and feed-forward control based on the FF current If, in addition to the above feedback control, is performed so as to control current applied to the lower coil 46.

When the exhaust valve 10 actually reaches the fully open position at time t4, the displacement deviation ΔX becomes equal to zero, and the FB current Ib is set to zero. At the same time, the FF current If is set to the above-indicated hold current If2, and the exhaust valve 10 is held in the fully open position.

Next, an operation to control driving of the exhaust valve 10 when it is closed will be described with reference to the time chart of FIG. 5. In FIG. 5, (a) indicates changes in the target displacement Xt and the actual displacement X of the exhaust valve 10 with time when it is closed, and (b), (c) and (d) indicate changes in the FB current Ib, FF current If and the command current I with time.

Figure 5:
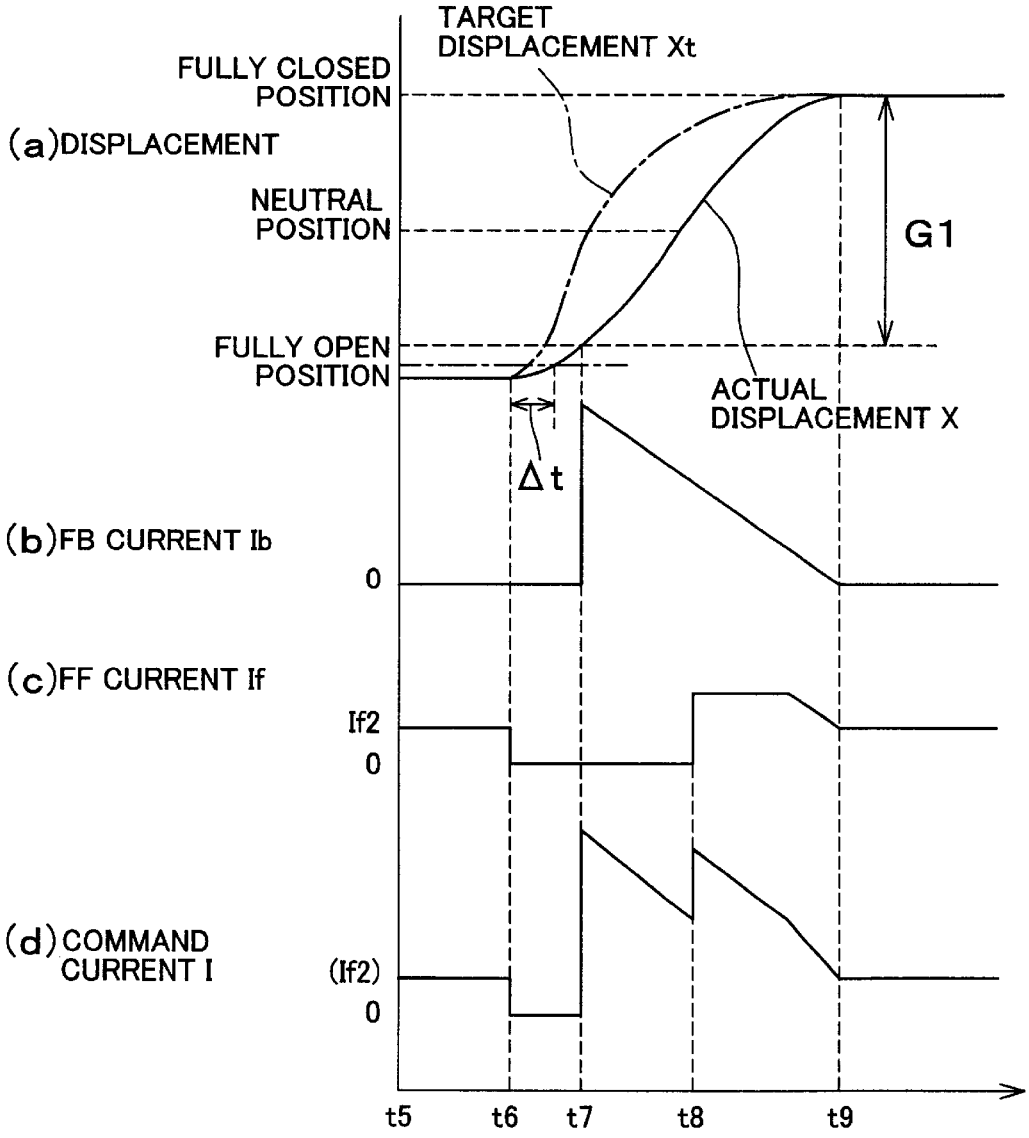
FIG. 5 is a time chart illustrating changes, with time, of target displacement and actual displacement of the exhaust valve of FIG. 1, feedback current, feed-forward current, and command current, when the exhaust valve is closed.

In a period between time t5 and time t6 as shown in FIG. 5, the magnitude of the FF current If is set to the hold current If2, and the FB current Ib is set to zero. Thus, the command current I supplied to the lower coil 46 is made equal to the holding current If2, and the exhaust valve 10 is held in the fully open position.

In order to close the exhaust valve 10 from this initial position, the FF current If is initially set to zero at time t6, so that the supply of the command current I to the lower coil 46 is stopped, and the exhaust valve 10 is released from the fully open position. Since the command current I immediately after releasing of the exhaust valve 10 from the fully open position is equal to zero, a movable portion of the exhaust valve 10 displaces or moves toward the fully closed position under the biasing force of the lower spring 24. Between time t6 and time t7 at which an air gap G between the armature 28 and the upper core 32 reaches a predetermined value G1, both the FF current If and the FB current Ib are kept equal to zero.

The electronic control unit 50 estimates the magnitude of the external force that acts on the exhaust valve 10, based on the actual displacement X (indicated by a solid line at (a) in FIG. 5) measured at a point of time when a time period Δt has elapsed from the above-indicated time t6 at which the exhaust valve 10 is released from the fully open position. The above time period Δt is set to a value that allows estimation of the external force based on the actual displacement X to be completed within the period between time t6 and time t7. The smaller the actual displacement X from the fully open position measured at the point of time when the time period Δt has elapsed, the larger the estimated external force that acts against the closing action of the exhaust valve 10.

Figure 6:
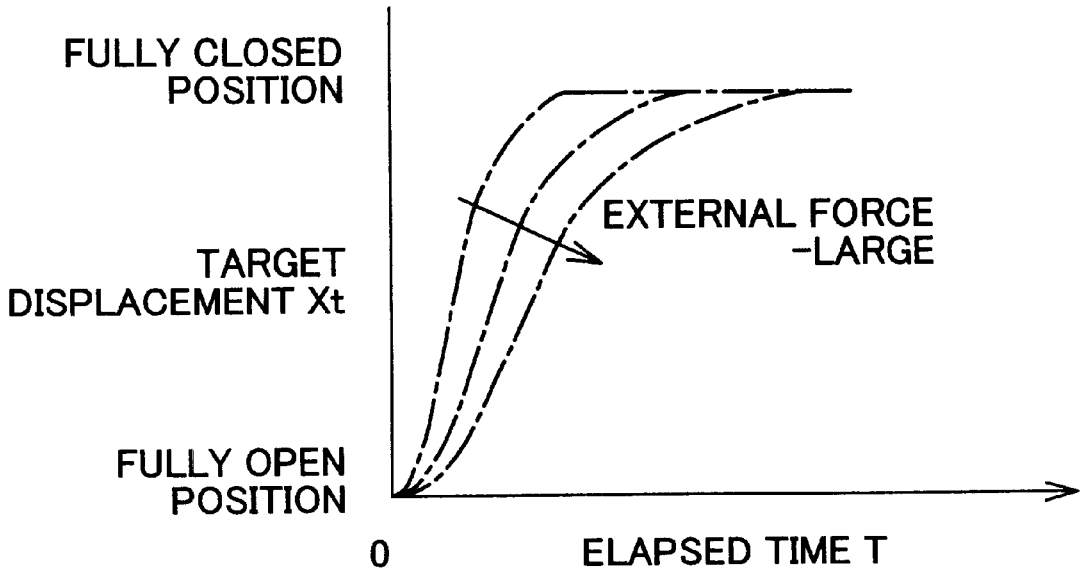
FIG. 6 is a graph showing a plurality of patterns of changes in the target displacement of the exhaust valve upon closing thereof, with respect to elapsed time, wherein each pattern corresponds to each of different magnitudes of the external force.

The electronic control unit 50 calculates the FF current If and the target displacement Xt of the exhaust valve 10 (as indicated by a one-dot chain line at (a) in FIG. 5), based on the estimated external force and the elapsed time T as measured from t6 at which the exhaust valve 10 is released from the fully open position. FIG. 6 shows a plurality of patterns of changes in the thus calculated target displacement Xt with time (elapsed time T), each of the patterns corresponding to each of different magnitudes of the external force. As is apparent from FIG. 6, the patterns of the target displacement Xt show a tendency that time required for the exhaust valve 10 to move from the fully open position to the fully closed position increases with an increase in the external force.

Then, the FF current If and the FB current Ib are calculated so that the actual displacement X of the exhaust valve 10 (as indicated by the solid line in FIG. 5) at each point of time becomes equal to the target displacement Xt at the corresponding point of time. Thus, the FB current Ib and the FF current If are set in view of the external force.

More specifically, the FF current If is calculated based on the estimated external force and the elapsed time T, to be thereby set to a current value that causes the actual displacement X to follow the pattern of the target displacement Xt that is selected depending upon the external force. The patterns of changes in the thus calculated FF current If with respect to time (elapsed time T) and different magnitudes of the external force as shown in FIG. 4 also apply to the case where the exhaust valve 10 is closed.

Upon and after time t7 (in FIG. 5) at which the air gap G becomes equal to the predetermined value G1, the FB current Ib is calculated based on a deviation ΔX of the actual displacement X from the target displacement Xt that varies depending upon the external force. Namely, the FB current Ib is determined so that the displacement deviation ΔX is reduced. During a period between time t7 and time t8 at which the FF current If becomes larger than zero, the command value I is equal to the FB current Ib, and only feedback control based on the FB current Ib is performed so as to control current applied to the upper coil 42.

Once the elapsed time T reaches time t8 at which the FF current If becomes larger than zero, the FF current If is set to a value (larger than zero) that varies with the elapsed time T and the estimated external force. Thus, the command value I is calculated as a sum of the FF current If and the FB current Ib, and feed-forward control based on the FF current If, in addition to the above feedback control, is performed so as to control current applied to the upper coil 42.

When the exhaust valve 10 actually reaches the fully closed position at time t9, the displacement deviation ΔX becomes equal to zero, and the FB current Ib is set to zero. At the same time, the FF current If is set to the above-indicated hold current If2, and the exhaust valve 10 is held in the fully closed position.

Next, a control routine for controlling driving of the exhaust valve 10 will be described with reference to the flowchart of FIG. 7 and FIG. 8. The control routine as shown in the flowchart is repeatedly executed by the electronic control unit 50 at certain time intervals.

Figure 7:
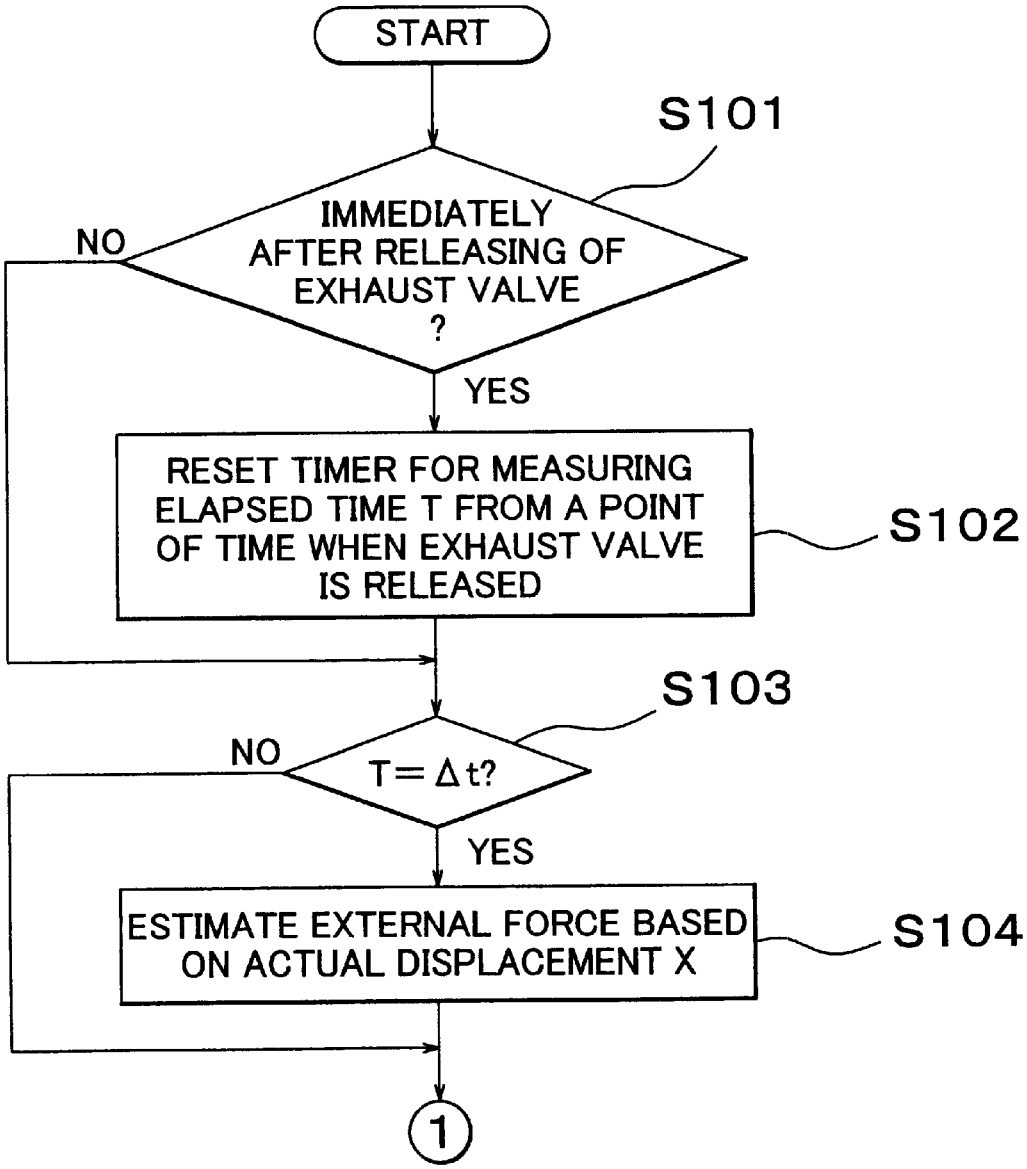
FIG. 7 is a flowchart illustrating a part of a control routine of controlling driving of the exhaust valve of FIG. 1.

Initially, it is determined in step S101 of FIG. 7 whether the exhaust valve 10 has just been released from the fully closed or fully open position. If an affirmative decision (YES) is obtained in step S101, a timer for measuring the elapsed time T from a point of time when the exhaust valve 10 is released is reset in step S102. In step S103, it is determined whether the elapsed time T becomes equal to the above-described time period Δt. If an affirmative decision (YES) is obtained in step S103, step S104 is executed to estimate the magnitude of the external force that acts against the movement of the exhaust valve 10, based on the actual displacement X of the exhaust valve 10 measured at a point of time when the elapsed time T becomes equal to Δt.

Figure 8:
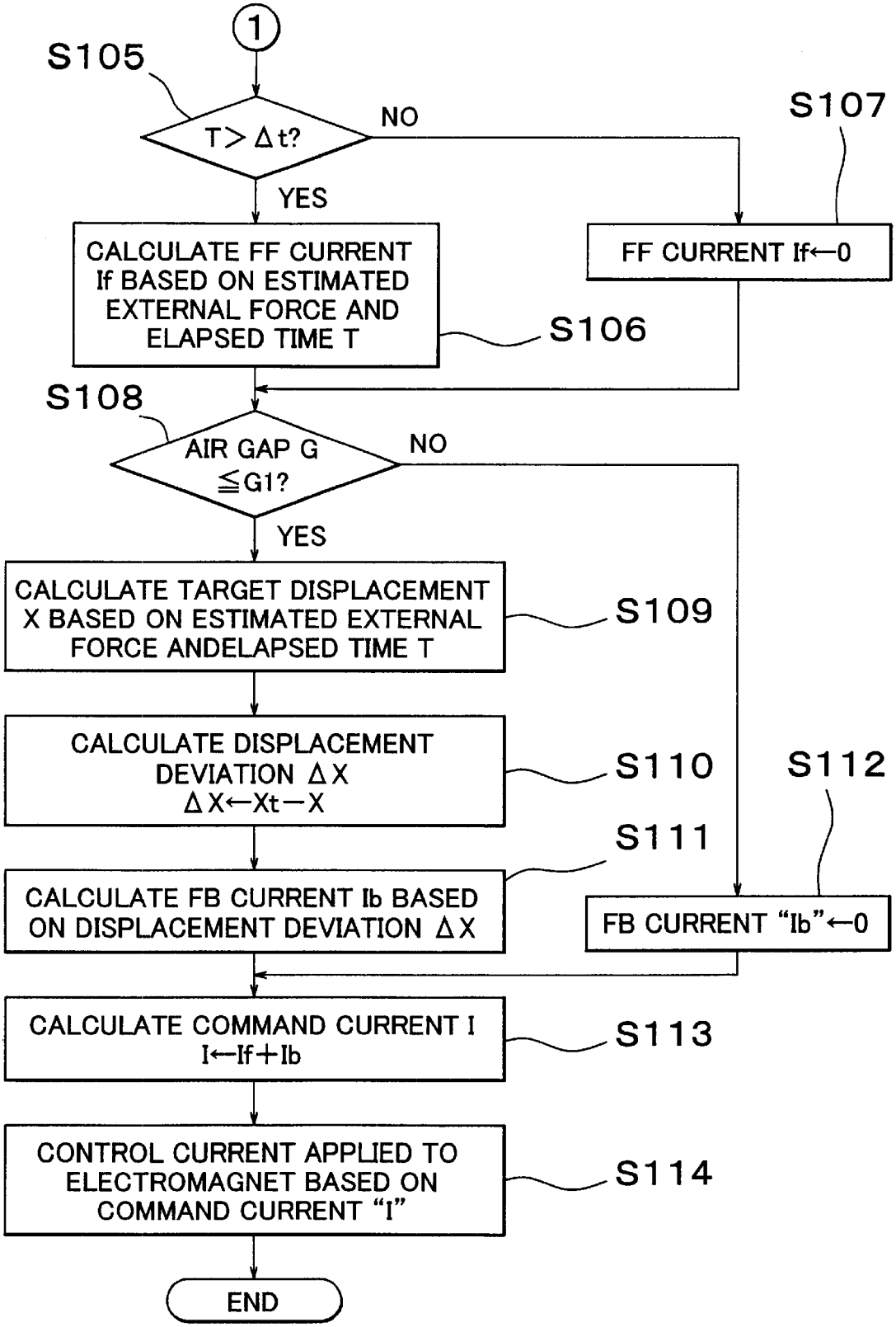
FIG. 8 is a flowchart illustrating another part of a control routine of controlling driving of the exhaust valve.

In step S105 of FIG. 8, it is determined whether the elapsed time T is larger than the time period Δt. If an affirmative decision (YES) is obtained in step S105, the FF current If is calculated in step S106 based on the estimated external force and the elapsed time T. As is apparent from FIG. 4 showing changes in the FF current If with respect to the external force and the elapsed time T, the FF current If is increased with an increase in the external force, so as to be set to a value suitable for compensating for an influence of the external force.

When a negative decision (NO) is obtained in step S105 as indicated above, namely, when it is determined that the elapsed time T is equal to or shorter than the time period Δt, the FF current If is set to zero.

In the next step S108, it is determined whether the air gap G between the armature 29 and each of the electromagnets 61, 62 is equal to or smaller than the predetermined value G1. The air gap G is defined as a distance between the armature 28 and one of the upper core 32 and the lower core 34 toward which the armature 28 is currently moving.

Namely, the air gap G represents a distance between the armature 28 and the lower core 34 when the exhaust valve 10 is opened, and the air gap G represents a distance between the armature 28 and the upper core 32 when the exhaust valve 10 is closed.

The above-indicated step S108 is executed so as to determine whether feedback control based on the FB current Ib should be started, depending upon the size of the air gap G. The timing of start of the feedback control is determined based on the magnitude of the air gap G for the following reason.

Assuming that substantially the same level of exciting current is supplied to the electromagnet 61 or 62, the electromagnetic force acting on the armature 28 is reduced with an increase in the air gap G. In other words, as the air gap G increases, an increased proportion of the electric energy supplied to the electromagnet 61 or 62 is likely to be wastefully consumed without contributing to attraction of the armature 28 toward the corresponding core. In the above-described control routine, therefore, the feedback control based on the FB current in accordance with the displacement deviation ΔX is performed only when it is determined that the air gap G is equal to or less than the predetermined value G1. If the air gap G is greater than the predetermined value G1, which means that the armature 28 is driven by the electromagnet 61 or 62 to be attracted to the corresponding core 32 or 34 with a low electric efficiency, the feedback control is substantially stopped by setting the FB current Ib to zero, so as to minimize the increase in the power consumption.

If an affirmative decision (YES) is obtained in step S108, step S109 is executed to calculate the target displacement Xt based on the estimated external force and the elapsed time T. The thus calculated target displacement Xt changes in accordance with the external force and the elapsed time T as shown in FIG. 3 when the exhaust valve 10 is opened, and changes in accordance with the external force and the elapsed time T as shown in FIG. 6 when the exhaust valve 10 is closed.

Subsequently, the displacement deviation ΔX is calculated in step S110 according to the following expression (1):

$$\Delta X = Xt - X \tag{1}$$

Then, the FB current Ib is calculated in step S111 based on the displacement deviation ΔX according to the following expression (2):

$$Ib = K \cdot \Delta X \tag{2}$$

In the above expression, "K" is a feedback gain, and is set to a constant value in this embodiment.

Here, the target displacement Xt used for calculating the displacement deviation ΔX is calculated so that the exhaust valve 10 displaces or moves more slowly as the external force that acts on the exhaust valve 10 against the movement thereof increases. Thus, the FB current Ib is set to a current value suitable for compensating for an influence of the external force.

If a negative decision (NO) is obtained in the above-indicated step S108, on the other hand, the FB current Ib is set to zero in step S112.

After the FB current Ib is determined in step S111 or step S112, a final command current "I", which is to be applied to a selected one of the electromagnets 61, 62, is calculated in step S113 according to the following expression (3):

$$I = Ib + If \tag{3}$$

In step S114, the command current I thus determined is applied to the selected one of the electromagnets 61, 62. More specifically, the command current I is supplied to the lower coil 46 when the exhaust valve 10 is opened, and the command current I is supplied to the upper coil 42 when the exhaust valve 10 is closed. In this manner, the magnitude of the electromagnetic force generated by each electromagnet 61, 62 is controlled through control of electric current applied to the corresponding electromagnet 61, 62. The control routine of FIG. 7 and FIG. 8 is then terminated after execution of step S114.

While the construction of the exhaust valve 10 and the manner of controlling driving of the valve 10 have been described in detail, an intake valve may be constructed like the exhaust valve 10, and driving of the intake valve may be controlled in substantially the same manner.

The illustrated embodiment yields the following advantages.

(1) The target displacement Xt of an engine valve, such as an intake valve or exhaust valve 10, is varied according to a selected pattern so that the engine valve moves or displaces more slowly or gently as the external force that acts against the movement of the valve increases. The FB current Ib is calculated based on the displacement deviation ΔX, so that the actual displacement X of the engine valve coincides with the target displacement Xt, and is thus set to an optimum value that compensates for an influence of the external force. By controlling current applied to the electromagnet 61 or 62 based on the command current I calculated from the FB current and the like, the engine valve is driven with an appropriate magnitude of electromagnetic force in accordance with the external force. This arrangement may avoid a situation that the engine valve is driven with a reduced operating stability, due to insufficient electromagnetic force relative to the required force for driving the engine valve. The above arrangement may also avoid a situation that the engine valve is driven with excessively large electromagnetic force, which may result in an increase in the power consumption and/or noise and vibrations occurring upon opening and closing of the valve.

(2) In the control of current applied to the electromagnet 61, 62 for opening and closing the engine valve, the FF current If is set to a current value for making the actual displacement X of the engine valve equal to the target displacement Xt, based on the external force and the elapsed time T. The control of current applied to the electromagnet 61, 62 is then performed based on the command current calculated from the FF current If and the feedback current Ib. Thus, the control of current applied to the electromagnet 61, 62 for opening and closing the engine valve includes feed-forward control based on the FF current If, and therefore the current control can be performed without suffering from a time delay.

(3) The external force that acts on the engine valve is estimated based on the actual displacement X of the engine valve measured when time Δt has elapsed from a point of time when the command current I that had been kept equal to the hold current If2 was set to zero (at time t1 in FIG. 2 and t6 in FIG. 5). The time Δt is set to a period that expires before a point of time (t3) at which the command current I that has been kept equal to zero is made larger than zero, namely, before the feedback control based on the FB current Ib is started with the air gap G becoming larger than the predetermined value G1. Thus, the external force is estimated based on the actual displacement X of the engine valve at the point of time when the time Δt has elapsed, before the electromagnet that has been placed in the de-energized state (after being supplied with the hold current If2) is energized again with the FB current Ib. The actual displacement X of the engine valve measured at this time is not affected by the electromagnetic force generated by the electromagnets, and therefore takes an appropriate value that accurately reflects the external force acting on the engine valve. Accordingly, the external force can be appropriately estimated based on the actual displacement X, without requiring a new sensor for estimating the external force acting on the engine valve.

The illustrated embodiment of the invention may be modified as follows.

Figure 9:
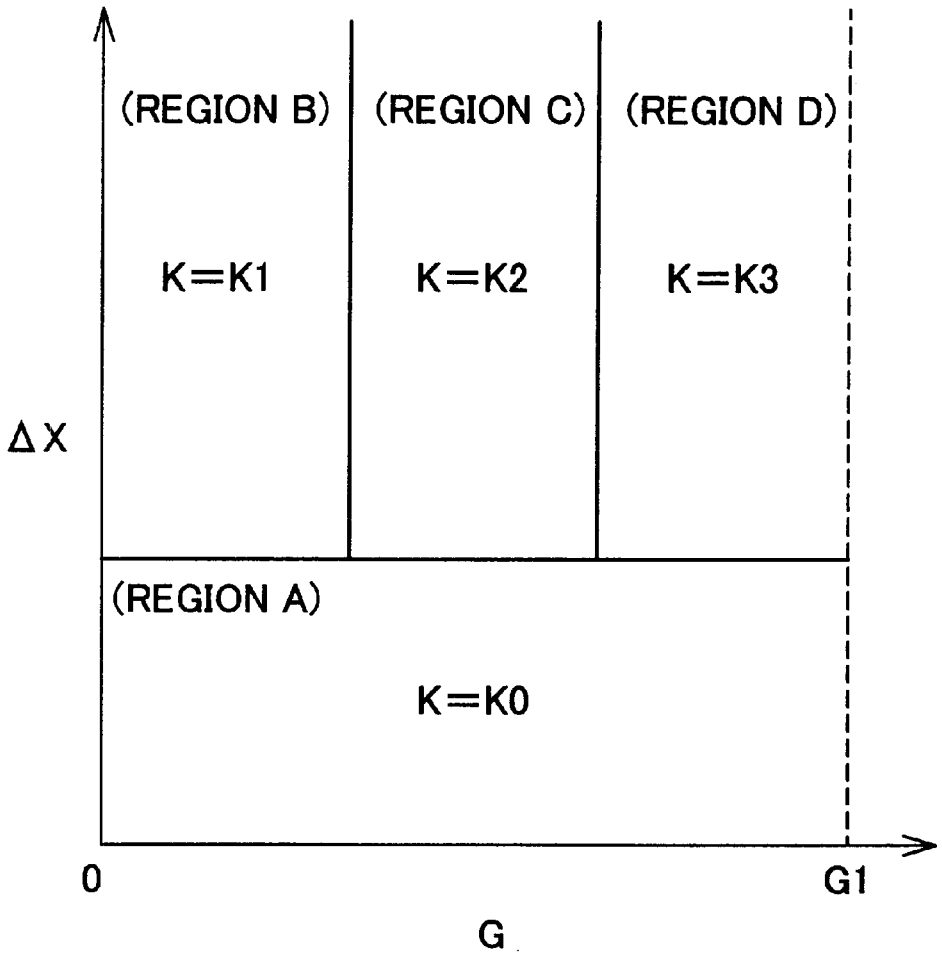
FIG. 9 is a map that is referred to when a feedback gain is determined.

The feedback gain "K" used in the calculation of the FB current Ib based on the displacement deviation ΔX may be varied depending upon the size of the air gap G and the magnitude of the displacement deviation ΔX, with reference to a map as shown in FIG. 9, for example. In this case, the feedback gain "K" is set to one of predetermined values K0, K1, K2 and K3 corresponding to respective regions A, B, C and D of FIG. 9 that are determined or defined based on the air gap G and the displacement deviation ΔX. With regard to the predetermined values K1 to K5, the relationship as indicated in the following expression (4) is established in advance.

$$K0<K1<K2<K3 \quad (4)$$

where K0 is equal to zero.

The feedback gain "K", which can be set to a variable as described above, is set to zero when the displacement deviation ΔX is extremely small, and is increased step by step as the air gap G increases when the displacement deviation ΔX is larger than a certain value. Thus, the feedback gain "K" is increased with an increase in the air gap G, because the electromagnetic force that acts on the engine valve upon application of a certain command current I to the selected electromagnet decreases as the air gap G increases. Assuming that the same command current I is supplied to the selected electromagnet, the electromagnetic force that acts on the engine valve decreases as the air gap G increases. By setting the feedback gain K to larger values as the air gap G increases as described above, therefore, an appropriate magnitude of the electromagnetic force that is suitable for the size of the air gap G can be generated at the selected electromagnet. Thus, the actual displacement X of the engine valve can be controlled to the target displacement Xt in a relatively short time, while following the selected pattern of the target displacement Xt with high accuracy and reliability. With the feedback gain K being made variable as described above, only the necessary command current I set in accordance with the air gap G is supplied to the selected electromagnet, thus reducing or suppressing adverse influences of noises and the like on the displacement sensor 52, which might be otherwise caused by excessively large current supplied to the selected electromagnet.

The feedback gain "K" may be set to a variable in a desired manner. For example, the feedback gain "K" may be determined solely based on the air gap G such that the feedback gain "K" is increased step by step as the air gap G increases. Alternatively, the feedback gain K may be continuously changed in accordance with the air gap G, using the following expression (5) representing the relationship between the air gap and the feedback gain, without using a map, or the like.

$$K=Ka\cdot G+Kb \quad (5)$$

G: air gap

Ka, Kb : constant

In the illustrated embodiment, the command current I used when controlling current applied to each of the electromagnets 61, 62 is set based on the FB current Ib and the FF current If, so that the feedback control and the feed-forward control are both carried out. However, only the feedback control may be carried out, for example, by controlling current applied to each of the electromagnets 61, 62 solely based on the FB current Ib.

In the illustrated embodiment, the FB current Ib is calculated based on the displacement deviation ΔX, by calculating only the P term (proportional term) of PID control. It is, however, possible to calculate the I term (integral term) and the D term (differential term) as well as the P term (proportional term).

In the illustrated embodiment, the magnitude of the external force that acts on the engine valve is estimated based on the actual displacement X of the engine valve measured at a point of time when time Δt has elapsed from the time when the command current I that had been kept equal to the hold current If2 was set to zero. The invention, however, is not limited to this manner of estimation. For example, the magnitude of the external force that acts on the engine valve may be estimated based on the pressure of the combustion chamber 12, and/or the pressure within the relevant intake port or exhaust port. More specifically, an in-cylinder pressure sensor for detecting the pressure within the combustion chamber 12 and an intake-port pressure sensor for detecting the pressure within an intake port may be provided, and the magnitude of the external force acting on the intake valve may be estimated based on a difference between the pressure within the combustion chamber 12 and the pressure within the intake port. Similarly, an in-cylinder pressure sensor for detecting the pressure within the combustion chamber 12 and an exhaust-port pressure sensor for detecting the pressure within an exhaust port may be provided, and the magnitude of the external force acting on the exhaust valve may be estimated based on a difference between the pressure within the combustion chamber 12 and the pressure within the exhaust port.

Furthermore, the magnitude of the external force acting on the engine valve varies with an engine load, as described above. The engine load may be calculated based on an output of an accelerator position sensor for detecting the position of an accelerator pedal (or the amount of depression of the accelerator pedal), and an output of an engine speed sensor for detecting the engine speed. Then, the magnitude of the external force acting on the engine valve may be estimated based on the engine load thus calculated. The engine load may also be calculated based on an output of a throttle opening sensor for detecting the opening angle or degree of a throttle valve, or an output of an air flow meter for detecting the amount (or flow rate) of the intake air drawn into the internal combustion engine, in place of the output of the accelerator position sensor.

Also, the magnitude of the external force acting on the engine valve varies with the valve timing with which the engine valve is opened and closed. Thus, the magnitude of the external force acting on the engine valve, which has been estimated based on the engine load, may be corrected by suitably adjusting the valve timing.

What is claimed is:

1. A drive control apparatus for controlling driving of an engine valve of an internal combustion engine, utilizing an electromagnetic force generated by at least one electromagnet, comprising:

an estimating unit that estimates a magnitude of an external force applied to the engine valve;

a setting unit that sets a target operating state of the engine valve in view of the magnitude of the external force estimated by the estimating unit, so that a displacement pattern of the engine valve is changed depending upon the estimated magnitude of the external force; and a control unit that controls a current applied to the at least one electromagnet, in accordance with an actual operating state and the target operating state of the engine valve, so that the actual operating state substantially coincides with the target operating state set by the setting unit.

2. A drive control apparatus according to claim 1, wherein the estimating unit estimates the magnitude of the external force based on the actual operating state of the engine valve that is detected while the at least one electromagnet is held in a non-energized state in which no current is applied to the engine valve.

3. A drive control apparatus according to claim 2, wherein the estimating unit estimates the magnitude of the external force based on the actual operating state of the engine valve detected within a predetermined period of time that starts when the engine valve is released from one of a fully closed position and a fully open position.

4. A drive control apparatus according to claim 1, wherein the control unit calculates a feedback current having a current value that varies with a deviation of the actual operating state from the target operating state, and controls the current applied to the at least one electromagnet, based on the calculated feedback current.

5. A drive control apparatus according to claim 4, wherein the control unit sets a feed-forward current having a current value that is added to the feedback current so as to make the actual operating state substantially equal to the target operating state, and controls the current applied to the at least one electromagnet, based on the feed-forward current and the feedback current.

6. A drive control apparatus according to claim 5, wherein the timing of application of the feed-forward current is advanced and the current value of the feed-forward current is increased as the external force that acts on the engine valve against a movement thereof increases.

7. A drive control apparatus according to claim 5, wherein the estimating unit estimates the magnitude of the external force based on the actual operating state of the engine valve that is detected while the at least one electromagnet is held in a non-energized state in which no current is applied to the engine valve, prior to application of the feedback current to the at least one electromagnet.

8. A drive control apparatus according to claim 4, wherein the estimating unit estimates the magnitude of the external force based on the actual operating state of the engine valve that is detected while the at least one electromagnet is held in a non-energized state in which no current is applied to the engine valve, prior to application of the feedback current to the at least one electromagnet.

9. A drive control apparatus according to claim 4, wherein the control unit sets a feedback gain used when calculating the feedback current, such that the feedback gain increases as an air gap between the engine valve and a selected one of the at least one electromagnet increases.

10. A drive control apparatus according to claim 9, wherein the control unit sets a feed-forward current having a current value that is added to the feedback current so as to make the actual operating state substantially equal to the target operating state, and controls the current applied to the at least one electromagnet, based on the feed-forward current and the feedback current.

11. A drive control apparatus according to claim 9, wherein the estimating unit estimates the magnitude of the external force based on the actual operating state of the engine valve that is detected while the at least one electromagnet is held in a non-energized state in which no current is applied to the engine valve, prior to application of the feedback current and the feed-forward current to the at least one electromagnet.

12. A drive control apparatus according to claim 1, wherein the control unit starts applying the current to the at least one electromagnet when an air gap between the engine valve and a selected one of the at least one electromagnet becomes equal to or less than a predetermined value during movement of the engine valve toward the selected electromagnet.

13. A drive control apparatus according to claim 1, wherein the control unit controls the current applied to the at least one electromagnet, such that time required for the engine valve to move from one of a fully closed position and a fully open position to the other position increases with an increase in the external force that acts on the engine valve against a movement thereof.

14. A drive control apparatus according to claim 1, wherein the target operating state is a target displacement of the engine valve, and the actual operating state is an actual displacement of the engine valve.

15. A drive control apparatus according to claim 14, wherein the setting unit stores a plurality of target displacement patterns representing changes in the target displacement with time, and selects one of the target displacement patterns depending upon the external force that acts on the engine valve against a movement thereof, so that the control unit controls the current applied to the at least one electromagnet based on the selected target displacement pattern.

16. A method of controlling driving of an engine valve of an internal combustion engine, utilizing an electromagnetic force generated by at least one electromagnet, comprising the steps of:

estimating a magnitude of an external force applied to the engine valve;

setting a target operating state of the engine valve in view of the estimated magnitude of the external force, so that a displacement pattern of the engine valve is changed depending upon the estimated magnitude of the external force; and controlling a current applied to the at least one electromagnet, in accordance with an actual operating state and the target operating state of the engine valve, so that the actual operating state substantially coincides with the target operating state.

17. A method according to claim 16, wherein the magnitude of the external force is estimated based on the actual operating state of the engine valve that is detected while the at least one electromagnet is held in a non-energized state in which no current is applied to the engine valve.

18. A method according to claim 17, wherein the magnitude of the external force is estimated based on the actual operating state of the engine valve detected within a predetermined period of time that starts when the engine valve is released from one of a fully closed position and a fully open position.

19. A method according to claim 16, wherein a feedback current having a current value that varies with a deviation of the actual operating state from the target operating state is calculated, and the current applied to the at least one electromagnet is controlled based on the calculated feedback current.

20. A method according to claim 19, wherein a feed-forward current having a current value that is added to the feedback current so as to make the actual operating state substantially equal to the target operating state is calculated, and the current applied to the at least one electromagnet is controlled based on the feed-forward current and the feedback current.

21. A method according to claim 20, wherein the timing of application of the feed-forward current is advanced and the current value of the feed-forward current is increased as the external force that acts on the engine valve against a movement thereof increases.

22. A method according to claim 20, wherein the magnitude of the external force is estimated based on the actual operating state of the engine valve that is detected while the at least one electromagnet is held in a non-energized state in which no current is applied to the engine valve, prior to application of the feedback current to the at least one electromagnet.

23. A method according to claim 19, wherein the magnitude of the external force is estimated based on the actual operating state of the engine valve that is detected while the at least one electromagnet is held in a non-energized state in which no current is applied to the engine valve, prior to application of the feedback current to the at least one electromagnet.

24. A method according to claim 19, wherein a feedback gain used when calculating the feedback current is determined such that the feedback gain increases as an air gap between the engine valve and a selected one of the at least one electromagnet increases.

25. A method according to claim 24, wherein a feed-forward current having a current value that is added to the feedback current so as to make the actual operating state substantially equal to the target operating state is set, and the current applied to the at least one electromagnet is controlled based on the feed-forward current and the feedback current.

26. A method according to claim 24, wherein the magnitude of the external force is estimated based on the actual operating state of the engine valve that is detected while the at least one electromagnet is held in a non-energized state in which no current is applied to the engine valve, prior to application of the feedback current and the feed-forward current to the at least one electromagnet.

27. A method according to claim 16, wherein the current starts being applied to the at least one electromagnet when an air gap between the engine valve and a selected one of the at least one electromagnet becomes equal to or less than a predetermined value during movement of the engine valve toward the selected electromagnet.

28. A method according to claim 16, wherein the current applied to the at least one electromagnet is controlled, such that time required for the engine valve to move from one of a fully closed position and a fully open position to the other position increases with an increase in the external force that acts on the engine valve against a movement thereof.

29. A method according to claim 16, wherein the target operating state is a target displacement of the engine valve, and the actual operating state is an actual displacement of the engine valve.

30. A method according to claim 29, wherein a plurality of target displacement patterns representing changes in the target displacement with time are stored, and one of the target displacement patterns is selected depending upon the external force that acts on the engine valve against a movement thereof, so that the current applied to the at least one electromagnet is controlled based on the selected target displacement pattern.

* * * * *